US008776992B2

(12) United States Patent
Morishita et al.

(10) Patent No.: US 8,776,992 B2
(45) Date of Patent: Jul. 15, 2014

(54) FEEDER APPARATUS FOR METAL STRIP

(75) Inventors: Keiichi Morishita, Tokyo (JP); Toshiyuki Nanaarashi, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 114 days.

(21) Appl. No.: 13/525,419

(22) Filed: Jun. 18, 2012

(65) Prior Publication Data

US 2013/0026010 A1 Jan. 31, 2013

(30) Foreign Application Priority Data

Jul. 28, 2011 (JP) ..... 2011-164939

(51) Int. Cl.
*B65H 20/22* (2006.01)

(52) U.S. Cl.
USPC ..... 198/621.3

(58) Field of Classification Search
None
See application file for complete search history.

(56) References Cited

U.S. PATENT DOCUMENTS

| | | | | |
|---|---|---|---|---|
| 2,468,620 | A * | 4/1949 | Gilbert et al. | 83/244 |
| 4,798,649 | A * | 1/1989 | Ross | 156/552 |
| 8,127,586 | B1 * | 3/2012 | Gunst | 72/405.16 |
| 2012/0085805 | A1 * | 4/2012 | Morishita | 226/67 |

FOREIGN PATENT DOCUMENTS

JP 3881991 B2 2/2007

* cited by examiner

*Primary Examiner* — Kavel Singh
(74) *Attorney, Agent, or Firm* — Birch, Stewart, Kolasch & Birch, LLP

(57) ABSTRACT

A feeder apparatus includes: a reciprocating block moved reciprocally when a metal strip with collar-equipped through-holes is fed; a moving block disposed above the reciprocating block and connected to a connecting member so as to move in a movement direction of the reciprocating block; a pin block that moves together with the moving block and on which feed pins inserted into the through-holes are provided; an up-down cam unit that moves the pin block up and down; and a cam that is rotated by converting reciprocal movement of the reciprocating block to rotation about the width direction of the metal strip and includes a channel of a predetermined shape, wherein a cam follower inserted into the channel of the cam is provided on the moving block.

2 Claims, 14 Drawing Sheets

FEEDER APPARATUS FOR METAL STRIP

CROSS-REFERENCE TO RELATED APPLICATION(S)

This application is based upon and claims the benefit of priority of the prior Japanese Patent Application No. 2011-164939, filed on Jul. 28, 2011, the entire contents of which are incorporated herein by reference.

FIELD

The present invention relates to a feeder apparatus that feeds a metal strip, in which a plurality of through-holes are formed at predetermined intervals in a conveying direction, in a predetermined direction.

BACKGROUND

A heat exchanger, such as an air conditioner, is constructed by stacking a plurality of heat exchanger fins, in which a plurality of through-holes have been formed to enable heat exchanger tubes to be inserted. Such heat exchanger fins are manufactured by a manufacturing apparatus for heat exchanger fins depicted in FIG. 15. The manufacturing apparatus for heat exchanger fins is equipped with an uncoiler 12 where a thin metal plate (or "metal strip") 10 made of aluminum or the like has been wound into a coil. The metal strip 10 pulled out from the uncoiler 12 via pinch rollers 14 is inserted into an oil applying apparatus 16 where machining oil is applied onto the surface of the metal strip 10, and is then supplied to a mold apparatus 20 provided inside a press apparatus 18.

The mold apparatus 20 internally includes an upper mold die set 22 that is capable of up-down movement and a lower mold die set 24 that is static. In the metal strip 10 that has passed through the mold apparatus 20, a plurality of collar-equipped through-holes 11 (also referred to simply as "through-holes" in the present specification), where collars of a predetermined height are formed around through-holes, are formed at predetermined intervals in a predetermined direction. After being conveyed a predetermined distance in the predetermined direction, the metal strip 10 is cut into predetermined lengths by a cutter 26 and then stored in a stacker 28.

The press apparatus 18 is provided with a feeder apparatus that intermittently conveys the metal strip 10, in which a plurality of through-holes 11 have been formed at predetermined intervals in a predetermined direction, toward the cutter 26. FIGS. 16 and 17 are diagrams useful in explaining the conveyance of the metal strip 10 by the operation of the feeder apparatus. The feeder apparatus causes feed pins 68 to advance from below into through-holes 11 formed in the metal strip 10 and conveys the metal strip 10 in the conveying direction by moving the feed pins 68 in a conveying direction. The metal strip 10 is placed on a reference plate 64. A slit 66 formed in a range in which the feed pins 68 move is formed in the reference plate 64. The feed pins 68 protrude upward from the slit 66.

The feed pins 68 are provided so as to protrude upward on a pin block 56 that is capable of moving in a horizontal direction and an up-down direction. When conveying the metal strip 10 in the conveying direction, the pin block 56 is raised and the feed pins 68 advance into the through-holes 11 of the metal strip 10 placed on the reference plate 64. The pin block 56 then moves in the conveying direction. After the metal strip 10 has been moved to a predetermined position, the pin block 56 is lowered and the feed pins 68 are withdrawn downward from the through-holes 11. After this, the pin block 56 then moves in the opposite direction to the conveying direction (i.e., in a return direction) while remaining in a state where the feed pins 68 do not contact the metal strip 10 to return to an initial position.

Next, the specific construction of an existing feeder apparatus and the operation thereof will be described with reference to FIGS. 18 to 20. The feeder apparatus includes a reciprocating block 50 that moves reciprocally in the conveying direction and a moving block 54 that is provided above the reciprocating block 50. The moving block 54 is fixed to a shaft 60, which spans between two fixed members 82*a*, 82*b* that are fixed facing one another near both ends of the reciprocating block 50, so as to be capable of moving in the same direction as the direction of movement of the reciprocating block 50. For this reason, the moving block 54 is capable of moving together with the shaft 60 in the direction of movement of the reciprocating block 50.

The pin block 56 that supports the feed pins 68 is provided above the moving block 54 and has two plates 56*a*, 56*b* disposed in that order in the up-down direction. A plurality of the feed pins 68 are attached to the pin block 56 so as to be sandwiched between the plates 56*a*, 56*b*. The pin block 56 is energized downwardly (i.e., toward the moving block 54) by an energizing means such as a spring, not depicted). The pin block 56 is therefore capable of moving together with the moving block 54 and when a force that acts upwardly against the energizing force of the energizing means acts upon the pin block 56, the pin block is raised toward the reference plate 64.

An up-down cam portion 80 is provided between the moving block 54 and the pin block 56. The up-down cam portion 80 is composed of an upper cam portion 76 fixed to the pin block 56 and a lower cam portion 78 provided on the moving block 54. Concave and convex portions are formed on the facing surfaces of the upper cam portion 76 and the lower cam portion 78. The lower cam portion 78 is formed on an upper surface of a wide member 78*a* that is placed on the moving block 54 positioned between the fixed members 82*a*, 82*b* and is wider than the moving block 54. The wide member 78*a* is formed with a suitable size so as to protrude beyond the moving block 54 and the pin block 56 toward both ends in the conveying direction.

The concave and convex portions of the upper cam portion 76 are formed on a surface that faces the lower cam portion 78 of the wide member 78*a*. The wide member 78*a* is capable of sliding on the moving block 54, with such movement being restricted by the fixed members 82*a*, 82*b*. That is, when the wide member 78*a* slides in the conveying direction of the metal strip 10, the conveying direction-side end of the wide member 78*a* will hit the inner wall surface of the fixed member 82*b* and when the wide member 78*a* slides in the opposite direction to the conveying direction, the opposite direction-side end of the wide member 78*a* will hit the inner wall surface of the fixed member 82*a*.

As depicted in FIG. 20, when the conveying direction-side end of the wide member 78*a* hits the fixed member 82*b*, the convex portions formed on the upper cam portion 76 and the lower cam portion 78 contact one another. For this reason, the pin block 56 is pressed upward against the energizing force of the energizing means and front end portions of the feed pins 68, 68, . . . provided on the pin block 56 advance inside the through-holes 11 of the metal strip 10 placed on the reference plate 64.

On the other hand, as depicted in FIG. 18 and FIG. 19, when the wide member 78*a* slides in the conveying direction (i.e., toward the fixed member 82*b*) and the other end of the wide member 78*a* hits the fixed member 82*b*, the concave portions and the convex portions formed on the upper cam portion 76 and the lower cam portion 78 fit together. For this reason, the pin block 56 is pressed against the moving block 54 by the energizing force of the energizing means and the front end portions of the feed pins 68, 68, . . . of the pin block 56 are withdrawn downward from the through-holes 11 of the metal strip 10 placed on the reference plate 64.

In such a feeder apparatus for the metal strip 10, the metal strip 10 placed on the reference plate 64 is conveyed in the direction of a fixed block 52*b*, with a positioning pin 84 for positioning the metal strip 10 at such position after conveyance also being provided. Such positioning pin 84 is provided so as to be capable of retractably protruding upward from the fixed block 52*b*. The positioning pin 84 is moved up and down by a positioning cam unit 86 provided on the fixed block 52*b*.

The positioning cam unit 86 is constructed of an upper cam unit 86*a* and a lower cam unit 86*b* where concave and convex portions are formed on facing surfaces, with the lower cam unit 86*b* being formed on a wide member 87 formed so as to be slidable and wider than the fixed block 52*b*. When the lower cam unit 86*b* slides in the direction where the convex portions contact one another, the front end portion of the positioning pin 84 protrudes above the reference plate 64 and is inserted into a through-hole 11 of the metal strip 10 placed on the reference plate 64 to position the metal strip 10.

On the other hand, when the lower cam unit 86*b* slides in the direction where the convex portions and the concave portions of both sides fit together, the front end portion of the positioning pin 84 becomes positioned below the reference surface of the reference plate 64 and is withdrawn from the collar-equipped through-hole 11 of the metal strip 10 placed on the reference plate 64 to release the positioning of the metal strip 10.

The wide member 87 of the lower cam unit 86*b* is linked by a shaft 90 to a slide member 88 that is slidably inserted into the fixed block 52*a* that faces the fixed block 52*b*. The shaft 90 is disposed so as to span between the two fixed blocks 52*a*, 52*b* disposed facing one another along the conveying direction. The shaft 90 is disposed so as to pass through the reciprocating block 50 and is provided so as to not obstruct movement of the reciprocating block 50.

When the reciprocating block 50 has moved in the conveying direction, the conveying direction-side end of the reciprocating block 50 will press an end portion of the wide member 87 of the lower cam unit 86*b* and thereby cause the lower cam unit 86*b* to slide in a direction where the convex portions contact the convex portions of the upper cam unit 86*a*. Conversely, when the reciprocating block 50 has moved in the opposite direction to the conveying direction, the end portion on the opposite side of the reciprocating block 50 to the conveying direction will press an end portion of the slide portion 88 provided at the opposite side of the shaft 90 to the wide member 87 and thereby cause the lower cam unit 86*b* to slide in a direction where the concave portions and convex portions of the upper cam unit 86*a* and the lower cam unit 86*b* fit together.

Next, a movement operation of the moving block will be described with reference to FIGS. 21 and 22. The moving block 54 is held in the center of the reciprocating block 50 by springs, not depicted. A holding means 92 that holds the moving block 54 reliably at a predetermined position on the reciprocating block 50 is provided on the reciprocating block 50 so as to protrude from the reciprocating block 50. The holding means 92 includes a pin member 98 whose front end portion protrudes from the reciprocating block 50 toward the moving block 54 and engages the moving block 54. The pin member 98 is constructed so as to be capable of holding and releasing the moving block 54 in accordance with movement of the reciprocating block 50. A wheel 97 that rotates along the conveying direction is provided at the lower end portion of the pin member 98 and is constantly energized downward by an energizing means 95.

A cam member 96 with a trapezoidal portion that projects upward is disposed below the reciprocating block 50. A lower end portion of the pin member 98 where the wheel 97 is provided contacts the surface of the cam member 96 due to the energizing force of the energizing means 95.

When the wheel 97 is positioned on the trapezoidal portion of the cam member 96, the front end portion of the pin member 98 is raised and becomes inserted in a concave portion of the moving block 54, thereby engaging the moving block 54. The holding means 92 is thereafter capable of reliably holding the moving block 54 at a predetermined position on the reciprocating block 50. On the other hand, when the moving block 54 has moved and approached the final end, the wheel 97 is located at a lower position than the trapezoidal portion of the cam member 96, the front end portion of the pin member 98 becomes withdrawn from the concave portion of the moving block 54, and the engagement of the pin member 98 and the moving block 54 is released.

Patent Document 1

Japanese Patent No. 3,881,991

SUMMARY

In a feeder apparatus with the construction described above, the pin member moves up and down due to the bottom end thereof riding up the trapezoidal portion of the cam member, and by connecting the pin member to the moving block in this way, the moving block becomes able to move in accordance with movement of the reciprocating block. That is, the reciprocating block will already be moving before the moving block starts to move, and due to the moving block that was stationary suddenly starting to move at the same speed as the movement speed of the reciprocating block, sudden acceleration occurs when the moving block starts to move. During stopping on the other hand, since the moving block stops suddenly due to the side surface of the moving block contacting a stopper, sudden deceleration also occurs during stopping.

In this way, in an existing feeder apparatus, the metal strip is conveyed by causing sudden acceleration and sudden deceleration of the moving block that moves the feed pins. However, there is a problem in that in this existing feeder apparatus where the metal strip that has the feed pins inserted into the through-holes is conveyed by way of sudden acceleration and sudden deceleration, an extremely large load is applied to the metal strip that is used for products. In recent years in particular, metal strips have been made extremely thin, resulting in the risk of deformation and the like of products due to the application of a large load. With a conveyance method that involves sudden acceleration and sudden deceleration, there is also the problem of poor feeding precision for the metal strip.

The present invention was conceived to solve the problem described above and aims to provide a feeder apparatus that is capable of conveying a metal strip without causing sudden acceleration or sudden deceleration.

A feeder apparatus for a metal strip according to the present invention feeds a metal strip in which a plurality of through-holes have been formed in a predetermined direction and includes: a reference plate having an upper surface on which the metal strip is placed and having slits that extend in a conveying direction of the metal strip and pass through the reference plate so as to connect the upper surface and a lower surface of the reference plate; a reciprocating block that is provided below the reference plate and is moved reciprocally in a conveying direction of the metal strip and an opposite direction to the conveying direction in parallel to the reference plate by a driving means; a moving block that is disposed above the reciprocating block and is connected to a connecting member so as to be movable in a moving direction of the reciprocating block between a pair of fixed members composed of fixed members that are fixed facing one another near both ends perpendicular to a direction of reciprocal movement of the reciprocating block; a pin block provided so as to be capable of moving together with the moving block and of moving up and down toward the reference plate, and on which feed pins, whose front end portions are inserted into the through-holes of the metal strip placed on the reference plate, are provided; an upper-lower cam portion composed of an upper cam portion fixed to the pin block and a lower cam portion provided on the moving block opposite the upper cam portion, wherein the upper-lower cam portion is operable when the reciprocating block moves in the conveying direction of the metal strip, to raise the pin block toward the reference plate so that the front end portions of the feed pins advance into the slits of the reference plate and are inserted into the through-holes of the metal strip placed on the upper surface, and is operable when the reciprocating block moves in the opposite direction to the conveying direction of the metal strip, to lower the pin block toward the reciprocating block so that the front end portions of the feed pins are withdrawn from the through-holes of the metal strip placed on the upper surface of the reference plate; a movement converting means that converts reciprocal movement of the reciprocating block to a rotational operation that has a width direction of the metal strip that is perpendicular to the conveying direction as an axis; and a cam that is rotated by the movement converting means with the width direction of the metal strip that is perpendicular to the conveying direction as an axis and has a channel formed in a predetermined shape along a surface of the cam, wherein a cam follower which is inserted into the channel of the cam and is capable of moving along the channel in the conveying direction according to the rotation of the cam is provided on the moving block, and the channel of the cam is formed in a shape so that the movement of the cam follower in the conveying direction causes the speed of the moving block immediately after the start of movement toward the conveying direction from the initial position to become gradually faster and the speed of the moving block before reaching the end position at the front end in the conveying direction to become gradually slower.

By using the above construction, the cam follower inserted into the channel of the cam is restrained in the channel of the cam and moves in the conveying direction along the shape of the channel. The shape of the channel is formed so that the movement of the cam follower in the conveying direction causes the speed of the moving block immediately after the start of movement from the initial position toward the conveying direction to become gradually faster and the speed of the moving block before reaching the end position at the front end in the conveying direction to become gradually slower. It is therefore possible to eliminate sudden acceleration and sudden deceleration due to the moving block being pulled by the reciprocating block as in the past, and to also reduce the load on the metal strip. Also, even when returning from the end position from the initial position, the moving block also moves along the shape of the channel of the cam by being restrained by the cam.

An inner wall surface on the conveying direction side of the channel and an outer circumferential wall of the cam may form a frame portion formed in a predetermined shape, and a second cam follower that is disposed so as to contact the outer circumferential wall of the cam, sandwiches the frame portion in combination with the cam follower, and is capable of moving in the conveying direction along the shape of the frame portion may be provided on the moving block.

With this construction, it is possible to sandwich the frame portion between the two cam followers and, when the moving block moves along the shape of the frame portion, to have the speed of the moving block immediately after the start of movement become gradually faster and the speed of the moving block before reaching the end position at the front end in the movement direction become gradually slower.

According to the present invention, it is possible to convey a metal strip without sudden acceleration or sudden deceleration. This means it is possible to raise the feeding precision without an excessive load being applied to the metal strip that is being conveyed.

DESCRIPTION OF EMBODIMENT(S)

Figure 1:
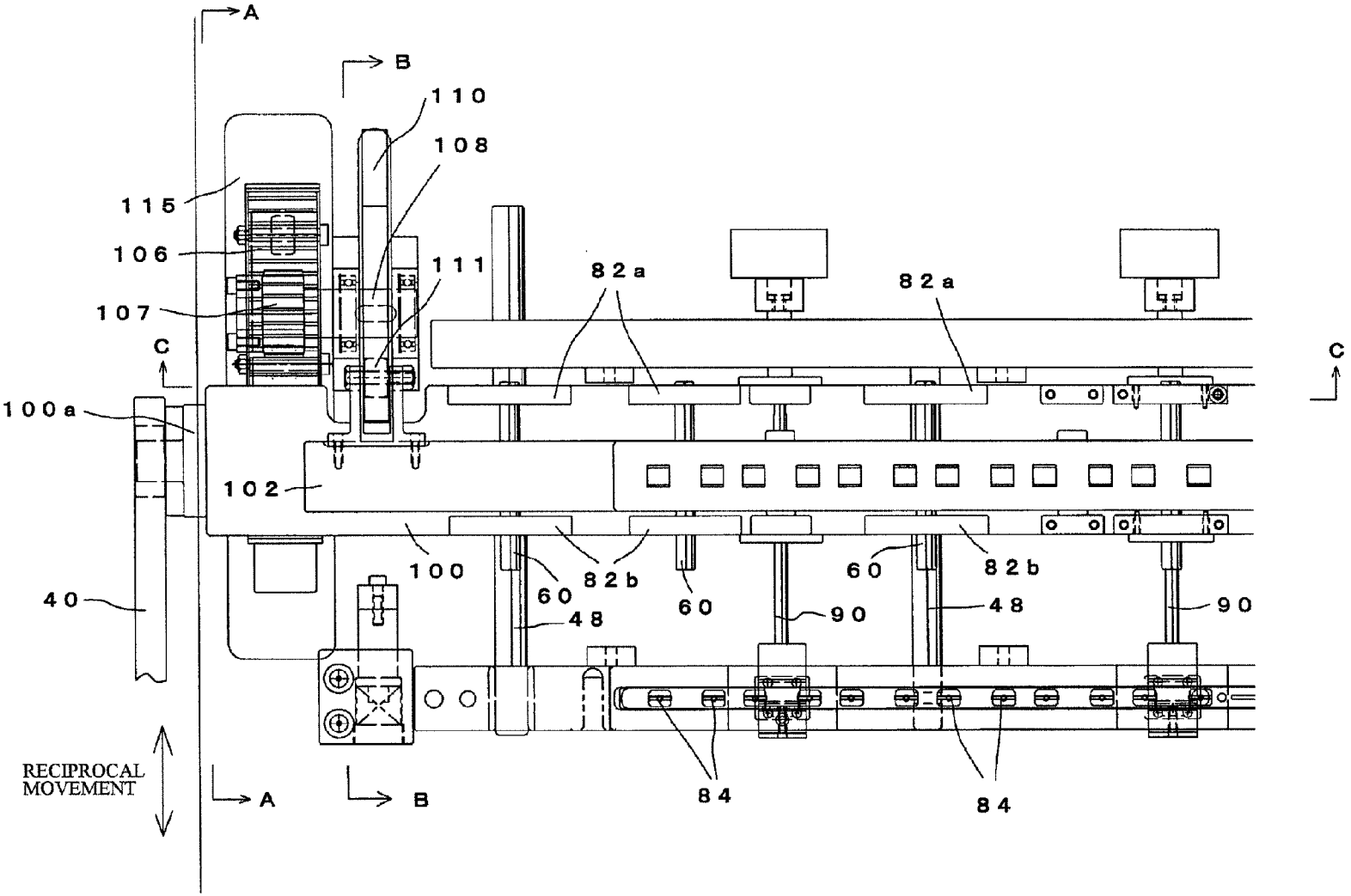
FIG. 1 is a plan view of a feeder apparatus for a metal strip according to the present invention.
Figure 2:
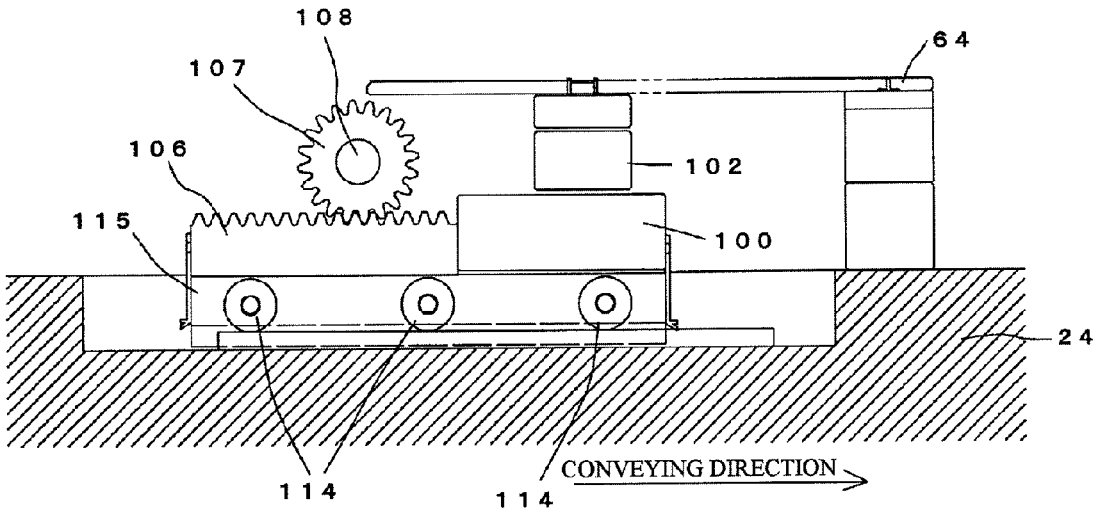
FIG. 2 is a side view of the feeder apparatus in FIG. 1 when looking from the direction A-A.
Figure 3:
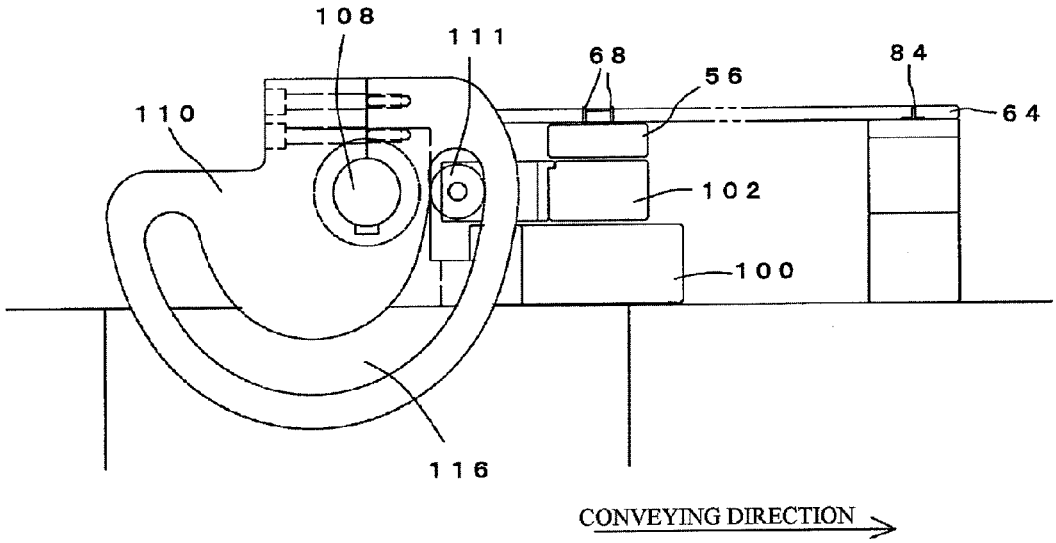
FIG. 3 is a side view of the feeder apparatus in FIG. 1 when looking from the direction B-B.
Figure 4:
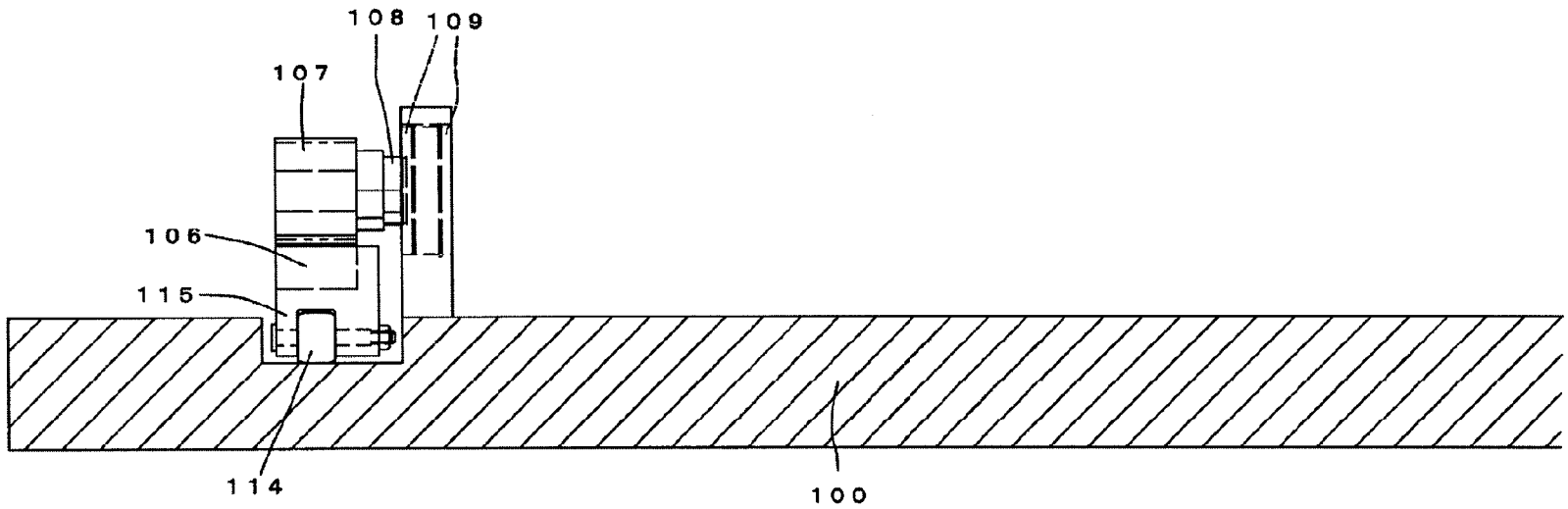
FIG. 4 is a front view of the feeder apparatus in FIG. 1 when looking from the direction C-C.

Preferred embodiments of a feeder apparatus for a metal strip according to the present invention will now be described. FIG. 1 is a plan view of a feeder apparatus. FIG. 2 is a side view of a feeder apparatus looking from the A-A direction in FIG. 1, FIG. 3 is a side view of the feeder apparatus looking from the B-B direction in FIG. 1, and FIG. 4 is a front view of the feeder apparatus looking from the C-C direction in FIG. 1. A manufacturing apparatus for heat exchanger fins in which this feeder apparatus is provided was described with reference to FIG. 14 in the "BACKGROUND" section, and is therefore not illustrated here. Also, some component elements that are the same as the component elements described in the "BACKGROUND" section have been assigned the same reference numerals and description thereof is omitted.

The overall operation of the feeder apparatus will be described first. The feeder apparatus is an apparatus that inserts a plurality of feed pins 68 into the through-holes 11 formed in the metal strip 10 and moves the feed pins 68 to pull the metal strip 10 via the feed pins 68 and convey the metal strip 10 to a predetermined position. After pulling the metal strip 10 to a predetermined position, the feed pins 68 are lowered to withdraw the feed pins 68 from the through-holes 11 of the metal strip 10, and the feed pins 68 then return to an initial position.

The feeder apparatus includes a reciprocating block 100 and a moving block 102 provided above the reciprocating block 100. An upper end portion of a lever 40 that constructs a driving means is connected to a protruding portion 100*a* that protrudes from one end of the reciprocating block 100.

Figure 5:
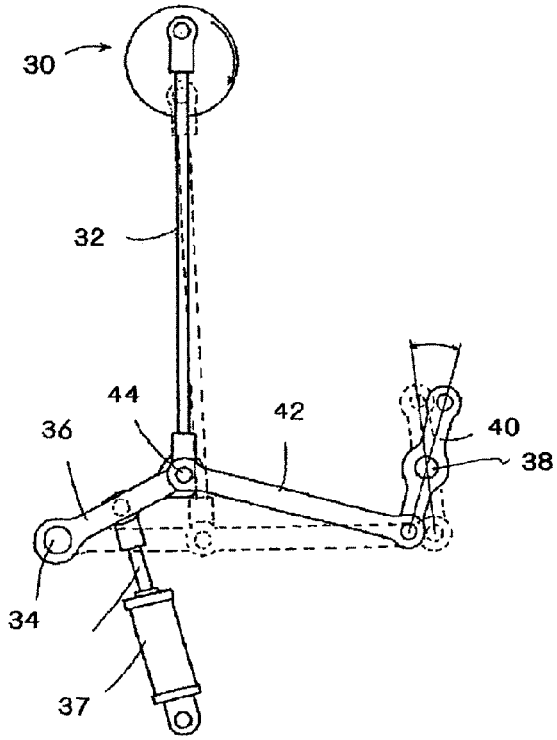
FIG. 5 is a diagram useful in depicting the construction of a driving means.

FIG. 5 depicts the driving means for driving the reciprocating block 100 of the feeder apparatus. In this driving means, a connecting rod 32 is linked to an eccentric pin of a crank 30 that rotates in synchronization with the press apparatus 18, and a first link 36 that swings about a pin 34 and a second link 42 that is connected to a lever 40 that rotates about a fulcrum shaft 38 are connected to a pin 44 at the lower end of the connecting rod 32. A cylinder apparatus 37 is provided on the first link 36 to adjust the swing angle thereof. In this way, by rotating the crank 30 in synchronization with the press apparatus 18, the connecting rod 32 causes the lever 40 to move reciprocally via the first link 36 and the second link 42.

Reciprocating Block

A rack gear 106 on which a gear is formed along the direction of reciprocal movement is provided on the reciprocating block 100. The rack gear 106 meshes with a pinion gear 107. Accordingly, due to the reciprocating block 100 reciprocally moving, the pinion gear 107 that meshes with the rack gear 106 rotates. The rack gear 106 and the pinion gear 107 correspond to a "movement converting means" mentioned in the range of the patent claims. A cam 110 is attached to a rotational shaft 108 of the pinion gear 107. The rotational shaft 108 extends in the width direction of the metal strip that is perpendicular to the conveying direction and the cam 110 is rotated by a rotational operation of the rotational shaft 108.

As described above, rotation of the cam 110 is carried out by rotating the pinion gear 107. Since a rotational operation of the pinion gear 107 is carried out due to the reciprocal movement of the rack gear 106, the rotational operation of the cam 110 is composed of repeated rotation in a predetermined range based on reciprocal movement of the lever 40.

As depicted in FIG. 2, the rack gear 106 is disposed on an upper surface of a rack bearing 115 fixed to the reciprocating block 100. Rollers 114 for ensuring that the rack bearing 115 moves smoothly are provided on a lower part of the rack bearing 115.

Moving Block

The construction and operation of the moving block 102 will now be described. The moving block 102 is disposed above the reciprocating block 100 but is not directly attached to the reciprocating block 100 and as described above moves reciprocally in the conveying direction of the metal strip 10 by converting linear reciprocal movement in the conveying direction of the reciprocating block 100 to rotational movement using the rack gear 106 and the pinion gear 107. The moving block 102 is provided so that shafts 60 pass through the moving block 102, the shafts 60 being suspended between two fixing members 82*a*, 82*b* provided so as to protrude upward at both end portions in the conveying direction of the reciprocating block 100. That is, the moving block 102 moves so as to be guided by the shaft 60 that is disposed along the conveying direction.

Figure 6:
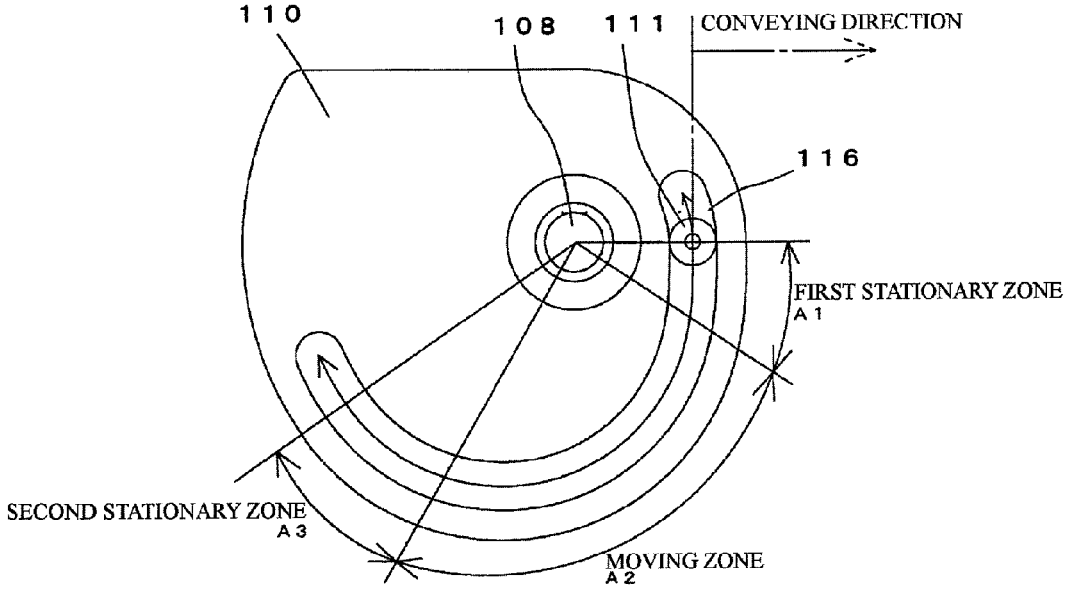
FIG. 6 is a diagram useful in depicting the shape of a cam and a cam follower.
Figure 7:
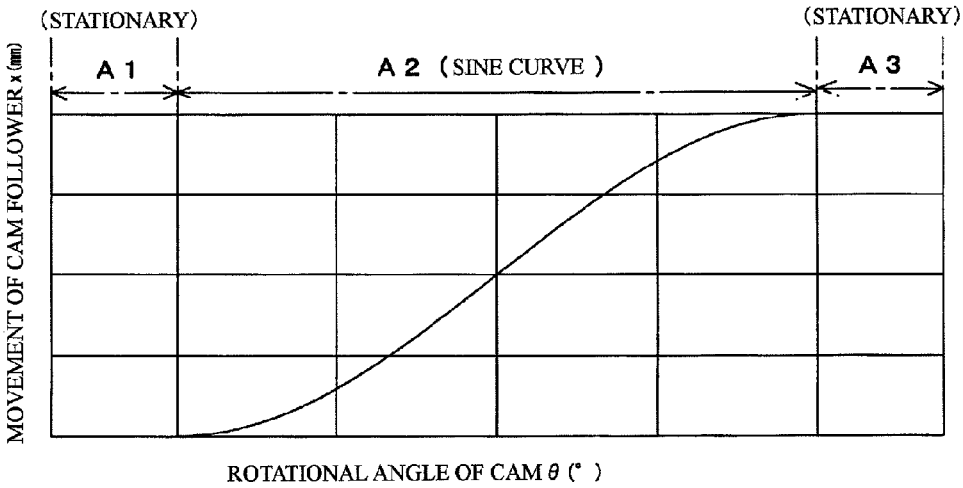
FIG. 7 is a graph depicting a relationship between the rotational angle of a cam and the distance moved by a cam follower.

FIG. 6 depicts the cam in plan view and FIG. 7 is a graph depicting the relationship between the distance moved by the moving block and the rotational angle of the cam. The cam 110 is a plate-like member and a channel 116 for restraining a cam follower 111 provided on an upstream end portion (in the conveying direction) of the moving block 102 is formed in the cam 110. By rotating the cam 110, the cam follower 111 housed inside the channel 116 moves along the shape of the channel 116 and the moving block 102 on which the cam follower 111 is provided also moves reciprocally in the conveying direction in keeping with the shape of the channel 116. The external form of the cam 110 may be any shape, but since a movement operation of the moving block 102 is controlled by the shape of the channel 116, the shape of the channel 116 is as described below.

The channel 116 formed in the cam 110 is formed in the overall shape of a smooth curve. A first stationary zone A1 where the moving block 102 is stopped is formed near one end of the channel 116. The first stationary zone A1 is formed in an arc with a suitable radius of curvature so that the cam follower 111 is not pressed even when the cam 110 rotates. Following the first stationary zone A1, a moving zone A2 is formed in the channel 116 so that the moving block 102 starts to move gradually with no sudden acceleration immediately after the start of movement from the initial position and so that the moving block 102 gradually accelerates thereafter. Near the final end of the moving zone A2, the channel 116 is formed in a shape so that the moving block 102 stops gradually toward the final end position without stopping suddenly. In addition, following the moving zone A2, a second stationary zone A3 where the moving block 102 is stopped is formed near the other end portion of the channel 116. The second stationary zone A3 is formed in an arc with a suitable radius of curvature so that the cam follower 111 is not pressed even when the cam 110 rotates. The first stationary zone A1, the moving zone A2, and the second stationary zone A3 of the channel 116 of the cam 110 described above are formed in a range (around 150°) through which the cam 110 rotates.

Note that when the cam follower 111 is positioned in the first stationary zone A1 of the channel 116, the reciprocating block 100 will already be moving but the moving block 102 will not have started moving and will still be stationary. While the moving block 102 is stationary at this position, the feed pins 68 are raised and the positioning pins 84 are lowered. When the cam follower 111 is positioned in the second stationary zone A3 of the channel 116, the reciprocating block 100 will still be moving but the moving block 102 will have already stopped. While the moving block 102 is stationary at this position, the feed pins 68 are lowered and the positioning pins 84 are raised. In this way, by providing the first stationary zone A1 and the second stationary zone A3, switching periods for the up-down positions of the respective pins are provided within the periods during which the moving block 102 is stationary.

As depicted in FIG. 7, the moving block 102 that moves in accordance with rotation of the cam 110 operates so that following a state where the moving block 102 is stopped, the position of the moving block 102 traces a sine curve relative to rotation of the cam 110, before stopping once again. That is, if the conveying direction is set as the plus (+) direction and the opposite direction to the conveying direction is set as the minus (−) direction, the moving block 102 moves off with gradually positive acceleration from the initial position until the moving block 102 starts to move and then gradually accelerates further before a maximum speed is reached at an intermediate position. After this, the moving block 102 decelerates from the intermediate position with a gradually increasing deceleration and as the moving block 102 approaches the final end position, the deceleration becomes more gradual as the moving block 102 stops. In this way, by forming the shape of the channel 116 of the cam 110 that moves the moving block 102 so that no sudden acceleration or sudden deceleration is produced in the movement of the moving block 102, it is possible to reduce the load upon the metal strip 10 into which the feed pins 68 provided on the moving block 102 have been inserted, and to also increase the feeding precision.

By restraining the cam follower 111 inside the channel 116 to move the moving block 102, it is possible to cause both the movement of the moving block 102 from the initial position to the end position (outward movement) and the movement from the end position to the initial position (return movement) to follow the rotation of the cam. That is, if a construction were used where no channel is formed in the cam 110 and the cam follower 111 is pressed by a peripheral end surface of the cam 110 that rotates, to return the moving block 102 that has moved to the end position to the initial position, it would be necessary to provide a spring or like on the moving block 102 or at the end position of the moving block 102 and to return the moving block 102 to the initial position using the energizing force of the spring. However, by inserting the cam follower 111 that is fixed to the moving block 102 into the channel 116 as in the embodiment described above, it is possible to move the moving block 102 using only rotation of the cam 110 even when the moving block 102 returns from the end position to the initial position, which means that there is no need to provide a spring or the like and contributes to a reduction in the number of components.

Operation of Feed Pins

The raising and lowering of the feed pins 68 in keeping with movement of the moving block 102 is the same as described in the "BACKGROUND" section, but will now be described again with reference to FIGS. 8 to 10. The pin block 56 is provided above the moving block 102. The pin block 56 has two plates 56*a*, 56*b* provided above and below one another. The pin block 56 is attached so that the plurality of feed pins 68 are sandwiched between the plates 56*a*, 56*b*. The pin block 56 is energized downward (toward the moving block 102) by energizing means such as a spring, not depicted. The pin block 56 is capable of moving together with the moving block 102 and when an upward force acts upon the pin block 56 against the energizing force of the energizing means, the pin block 56 is raised toward the reference plate 64.

An upper-lower cam portion 80 is provided between the moving block 102 and the pin block 56. The upper-lower cam portion 80 is composed of an upper cam portion 76 that is fixed to the pin block 56 and a lower cam portion 78 provided on the moving block 54. Concave and convex portions are formed on respective opposing surfaces of the upper cam portion 76 and the lower cam portion 78. The upper cam portion 76 is provided with convexes and concaves that protrude downward on the lower portion of the pin block 56. The lower cam portion 78 is formed on an upper surface of a wide member 78*a* that is wider (i.e., longer in the conveying direction) than the moving block 102 and is formed so as to protrude out from both ends in the conveying direction beyond the moving block 102 and the pin block 56. That is, the concaves and convexes of the upper cam portion 76 and the concaves and convexes of the lower cam portion 78 are formed in opposing surfaces.

The wide member 78*a* is capable of sliding above the moving block 102 with such movement being restricted by the fixed members 82*a*, 82*b*. That is, when the wide member 78*a* slides in the conveying direction, the conveying direction-side end portion of the wide member 78*a* contacts an inner wall surface of the fixed member 82*b* and when the wide member 78*a* slides in the opposite direction to the conveying direction, the end portion of the wide member 78*a* at the opposite end to the conveying direction contacts an inner wall surface of the fixed member 82*a*.

Figure 10:
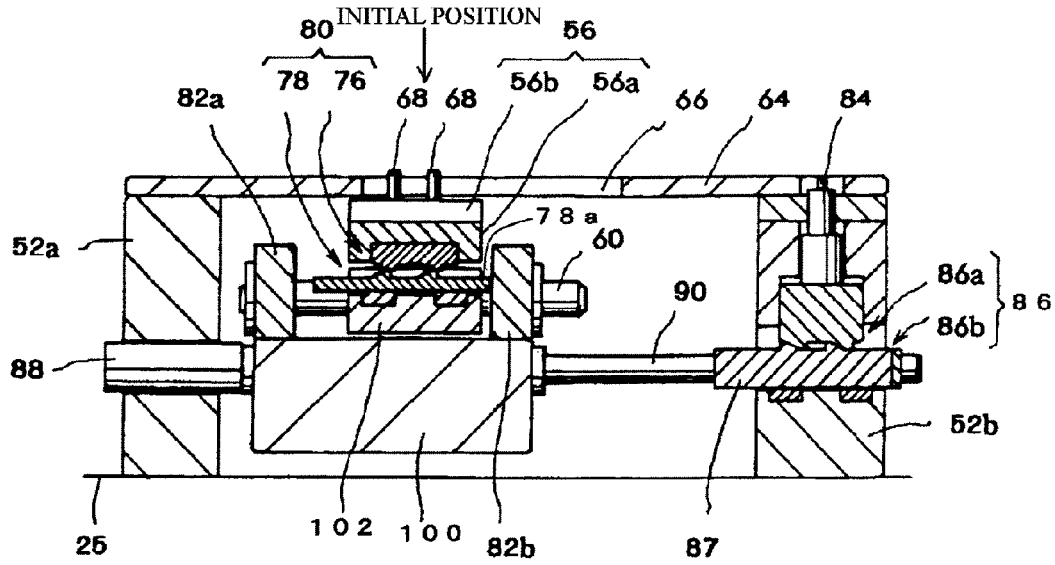
FIG. 10 is a diagram useful in depicting the construction in FIG. 9 at a point where the moving block has returned to the initial position.
Figure 11A:
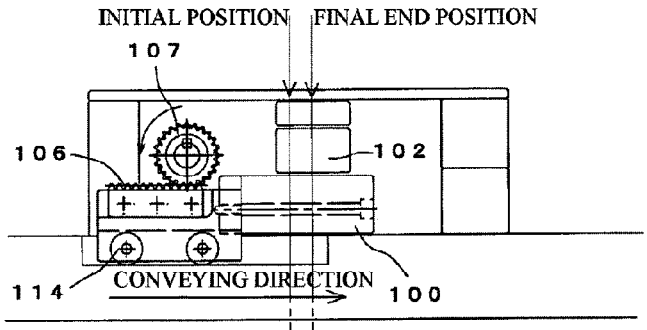
FIGS. 11A to 11E are diagrams useful in depicting movement of the reciprocating block in the conveying direction.
Figure 11B:
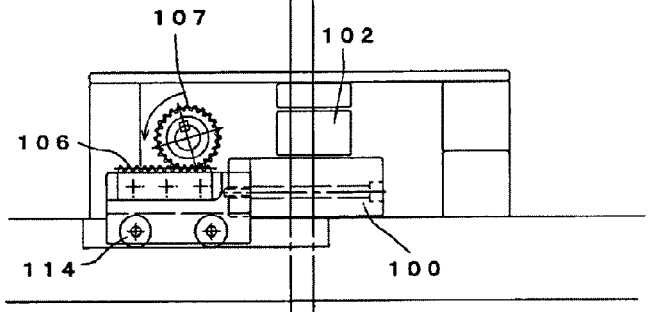
Figure 11C:
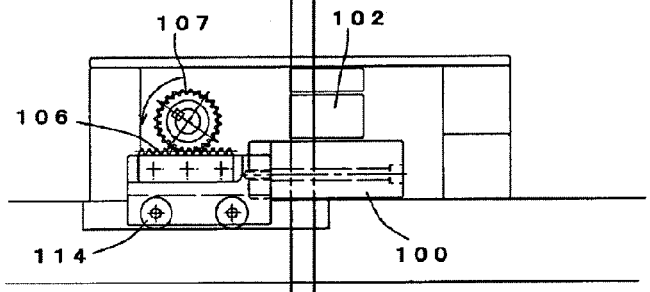
Figure 11D:
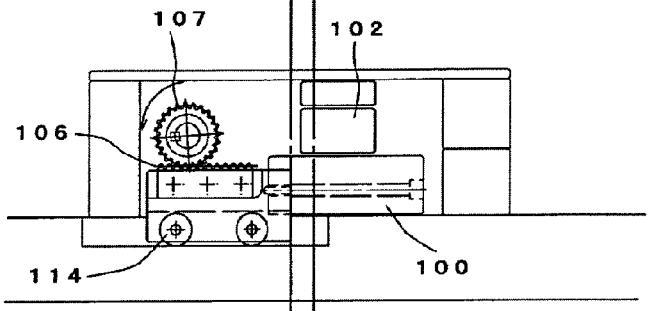
Figure 11E:
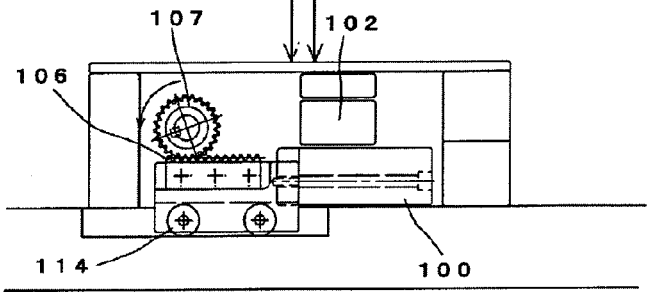

As depicted in FIG. 10, when the moving block 102 has returned to its initial position first and the reciprocating block 100 has subsequently returned to its initial position, the fixed member 82*b* contacts the conveying direction-side end portion of the wide member 78*a*. At this time, the convexes formed in the upper cam portion 76 and the lower cam portion 78 contact one another. This means that the pin block 56 is pressed upward against the energizing force of the energizing means and front end portions of the feed pins 68, 68, . . . provided on the pin block 56 are inserted into the collar-equipped through-holes 11 of the metal strip 10 placed on the reference plate 64.

Figure 8:
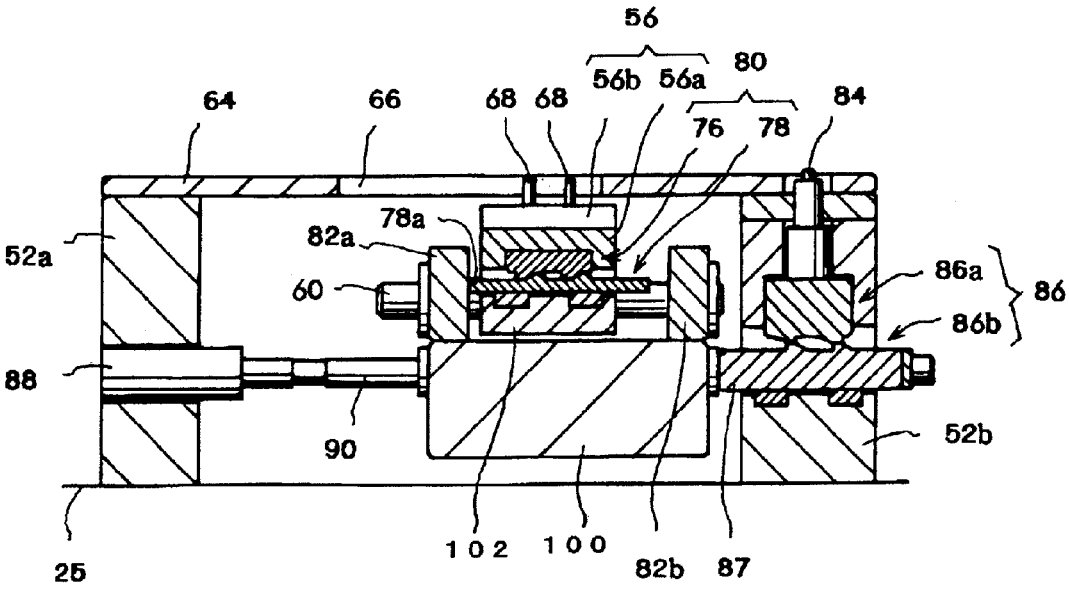
FIG. 8 is a diagram useful in depicting a construction for raising and lowering a pin block at a point where a moving block has reached a final end position and feed pins have been lowered.
Figure 9:
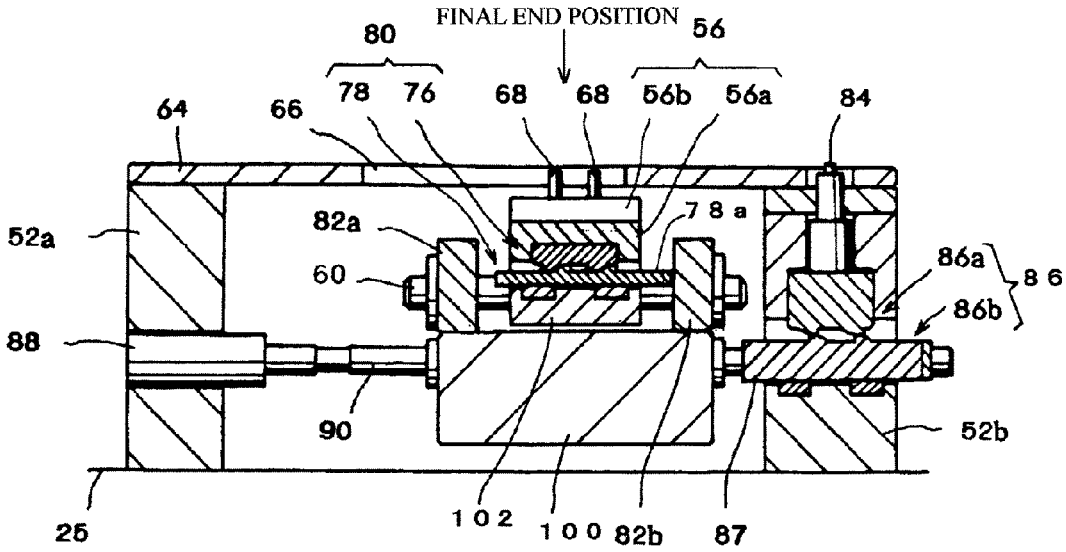
FIG. 9 is a diagram useful in depicting the construction in FIG. 8 at a point where the moving block is to be returned toward the initial position.

On the other hand, as depicted in FIG. 8, when the wide member 78*a* of the moving block 102 has slid in the conveying direction (the direction of the fixed member 82*b*) and reached the final end position, the reciprocating block 100 subsequently reaches the final end position. At this time, the fixed member 82*b* contacts the other end of the wide member 78*a* of the reciprocating block 100. When this happens, the concaves and the convexes formed in the upper cam portion 76 and the lower cam portion 78 fit together. This means that the pin block 56 is pressed onto the moving block 102 by the energizing force of the energizing means and the front end portions of the feed pins 68, 68, . . . of the pin block 56 are withdrawn from below from the collar-equipped through-holes 11 of the metal strip 10 placed on the reference plate 64.

That is, when the moving block 102 has returned from the final end position in the conveying direction to the initial position, the pin block 56 is pressed upward so that the feed pins 68 protrude upward and are inserted into the through-holes 11 of the metal strip 10 from below so that it becomes possible to convey the metal strip 10 using the feed pins 68. When the moving block 102 has moved to the final end position in the conveying direction, the pin block 56 is lowered, the feed pins 68 are withdrawn downward from the through-holes 11 of the metal strip 10, and the conveyance of the metal strip 10 ends.

Operation of Positioning Pins

The up-down movement of the positioning pins 84 in keeping with movement of the reciprocating block 100 is the same as described in the "BACKGROUND" section, but will now be described again with reference to FIGS. 8 to 10. As described earlier, the metal strip 10 conveyed by the feed pins 68 needs to be positioned at the conveyed-to position. For this reason, the positioning pins 84 are provided so as to be inserted into the through-holes 11 of the metal strip 10 after conveyance has ended. The positioning pins 84 are provided so as to protrude in the up/down direction from the fixed block 52*b*. The positioning pins 84 are raised and lowered by the positioning cam portion 86 provided on the fixed block 52*b*.

The positioning cam portion 86 is constructed of the upper cam portion 86*a* and the lower cam portion 86*b* that have concaves and convexes formed on respective opposing surfaces thereof that oppose one another, and the lower cam portion 86*b* is formed on the upper surface of the wide member 87 that is formed wider than the fixed block 52*b* and is capable of sliding. When the lower cam portion 86*b* slides in the direction where the convexes of both cam portions become joined, the front end portions of the positioning pins 84 protrude above the reference plate 64 and are inserted inside collar-equipped through-holes 11 of the metal strip 10 placed on the reference plate 64, thereby positioning the metal strip 10.

On the other hand, when the lower cam portion 86*b* slides in a direction where the convexes and concaves of the cam portions fit together, the front end portions of the positioning pins 84 become positioned below the reference surface of the reference plate 64 and are withdrawn from the collar-equipped through-holes 11 of the metal strip 10 placed on the reference plate 64, thereby releasing the positioning of the metal strip 10.

The wide member 87 of the lower cam portion 86*b* is coupled by shafts 90 to a slide member 88 that is slidably inserted into the fixed block 52*a* that is opposite the fixed block 52*b*. The shafts 90 are disposed so as to extend between the two fixed blocks 52*a*, 52*b* disposed opposite one another along the conveying direction. The shafts 90 are disposed so as to pass through the reciprocating block 100 and are provided so as to not obstruct movement of the reciprocating block 100.

When the reciprocating block 100 has moved in the conveying direction and reached the final end position, since the movement direction-side end portion of the reciprocating block 100 presses an end portion of the wide member 87 of the lower cam portion 86*b*, the lower cam portion 86*b* slides in a direction so that convexes of the cam portions 86*a* and 86*b* become joined. When the reciprocating block 100 has moved in the opposite direction to the conveying direction, since the end of the reciprocating block 100 on the opposite side to the conveying direction presses the end portion of the slide member 88 on the opposite side to the side where the wide member 87 of the shafts 90 is provided, the lower cam portion 86*b* slides in a direction so that the concaves and convexes of the cam portions 86*a* and 86*b* fit together.

In this way, due to the reciprocal movement of the reciprocating block 100, when the reciprocating block 100 has reached the final end position in the conveying direction, the positioning pins 84 are inserted into the through-holes 11 of the metal strip 10 to position the metal strip 10 and when the reciprocating block 100 has returned to the initial position, the positioning pins 84 are withdrawn from the through-holes 11 of the metal strip 10 to release the positioning.

Overall Operation

FIGS. 11A to 11E depict a time series for movement of the reciprocating block 100 in the conveying direction. As depicted in FIGS. 11A to 11E, by moving the lever 40 in the conveying direction, the reciprocating block 100 moves from the initial position to the final end position. The rack gear 106 moves in the horizontal direction in keeping with movement of the reciprocating block 100. The pinion gear 107 that meshes with the rack gear 106 rotates about the rotation shaft 108 in keeping with the movement of the rack gear 106.

On the other hand, due to rotation of the pinion gear 107, the cam 110 provided on the same shaft as the pinion gear 107 also rotates. Although the reciprocating block 100 is directly operated by the lever 40, the moving block 102 is operated not by the operation of the lever 40 but by the cam 110.

Figure 12A:
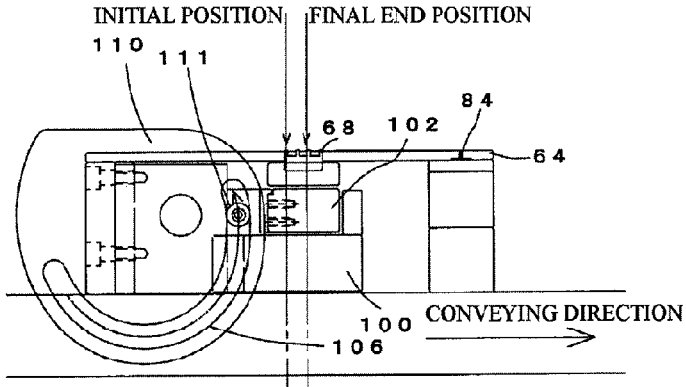
FIGS. 12A to 12E are diagrams useful in depicting movement of the moving block in the conveying direction based on rotation of the cams.
Figure 12B:
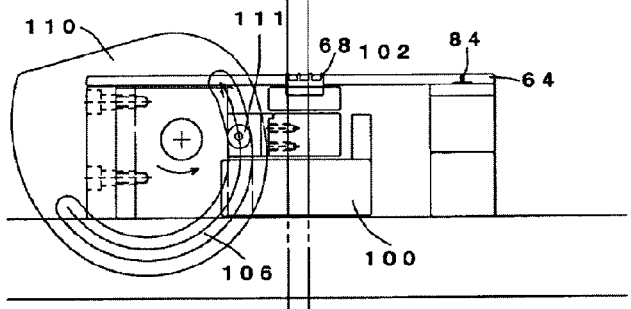
Figure 12C:
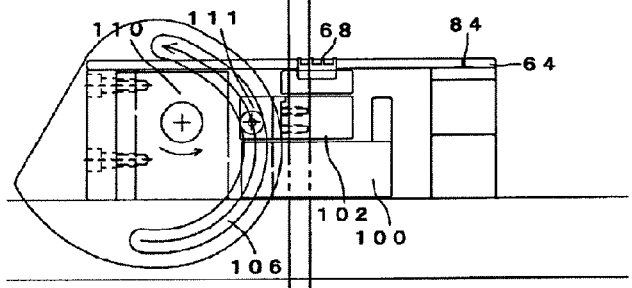
Figure 12D:
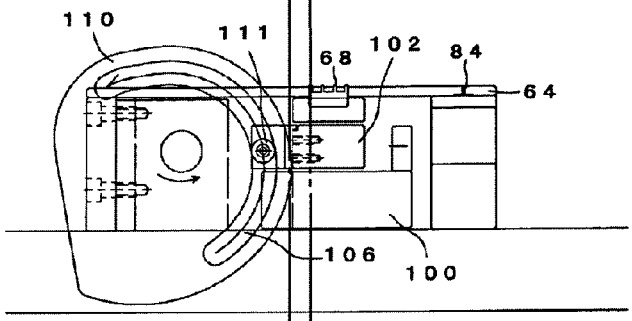
Figure 12E:
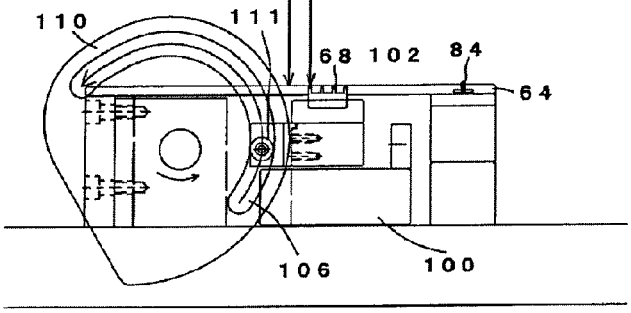
Figure 13A:
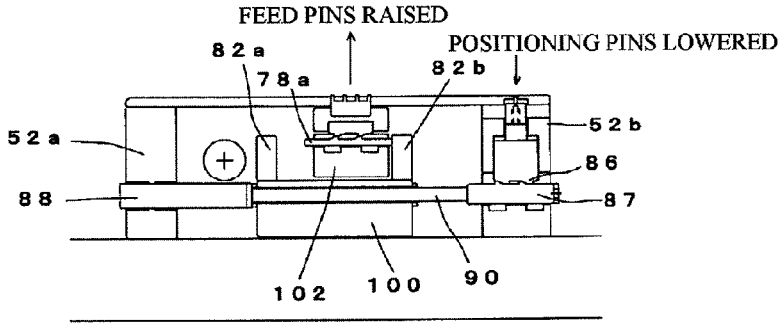
FIGS. 13A to 13E are diagrams useful in depicting up-down movement of the feed pins and the positioning pins based on movement of the moving block and movement of the reciprocating block.

FIGS. 12A to 12E and FIGS. 13A to 13E depict up-down movement operations of the feed pins and the positioning pins based on movement operations of the reciprocating block and the moving block in a time series. FIG. 12A and FIG. 13A depict a state where the moving block 102 is at a position (initial position) where the feed pins 68 are raised. At this time, the reciprocating block 100 starts to move in the conveying direction due to the operation of the lever 40. Even when the reciprocating block 100 starts to move and the cam 110 starts to rotate, the channel 116 of the cam 110 has a part which is not shaped so as to push the cam follower 111. Accordingly, at this time, the moving block 102 does not start to move and remains stationary.

Note that at this point, the end portion on the conveying direction-side of the wide member 78*a* contacts the inner wall surface of the fixed member 82*b*, the pin block 56 is raised, and the feed pins 68 are inserted into the through-holes 11. Also at this point, the end portion of the reciprocating block 100 on the opposite side to the movement direction presses the end portion of the slide member 88 of the shafts 90 so that the positioning pins 84 are lowered.

Figure 13B:
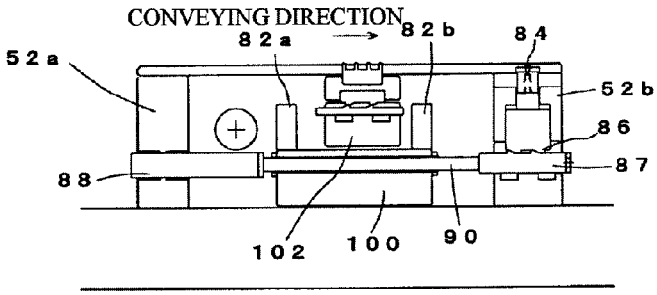
Figure 13C:
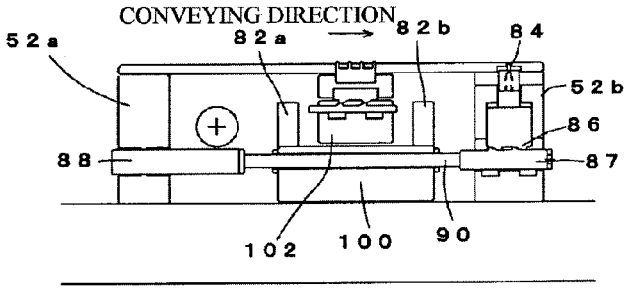
Figure 13D:
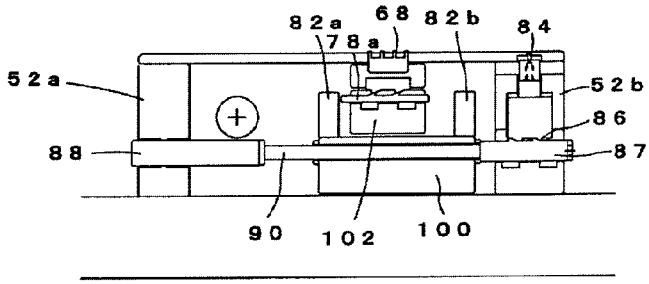
Figure 13E:
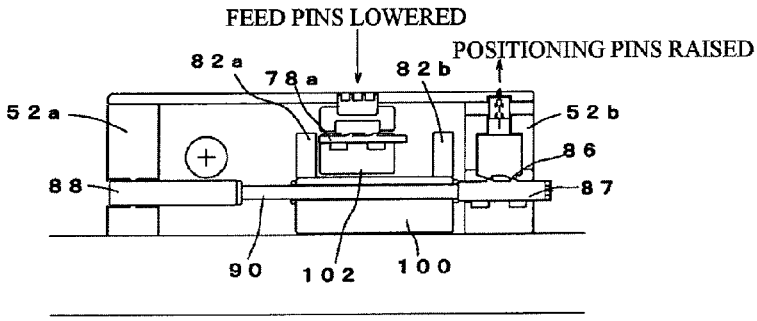

FIG. 12B and FIG. 13B depict a state where the moving block 102 starts moving due to rotation of the cams 110. FIG. 12C and FIG. 13C depict an intermediate position during the movement stroke of the moving block 102. FIG. 12D and FIG. 13D depict a state where the moving block 102 has reached the final end position and has stopped. FIG. 12E and FIG. 13E depict a state where, after the moving block 102 has stopped, the reciprocating block 100 has moved further and then stopped. At this point, the end portion of the wide member 78*a* at the opposite end to the conveying direction contacts the inner wall surface of the fixed member 82*a*, the pin block 56 is lowered, and the feed pins 68 are withdrawn downward from the through-holes 11. Also, at this point, the conveying direction-side end portion of the reciprocating block 100 presses the end portion of the wide member 87 of the shafts 90 to raise the positioning pins 84 and carry out positioning.

Note that when returning from the state depicted in FIG. 12E and FIG. 13E to the state depicted in FIGS. 12A and 13E, the reciprocating block 100 moves due to a reciprocating operation of the lever 40 and the moving block 102 moves along the channel 116 of the cam 110.

Second Embodiment

In the embodiment described above, a construction is used where the cam follower of the moving block is inserted in the channel of a cam and the moving block moves due to the cam follower moving along the channel. However, the present invention is not limited to a construction where a cam follower is inserted into a channel and may have the construction depicted in FIG. 14.

Figure 14:
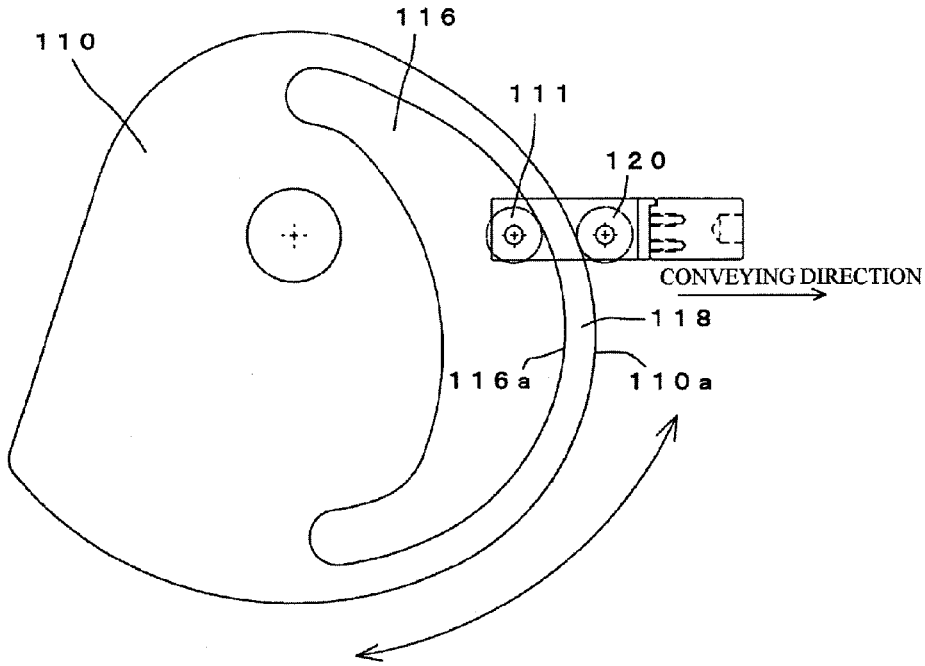
FIG. 14 is a diagram useful in depicting the shape of a cam and a cam follower according to a second embodiment of the present invention.
Figure 15:
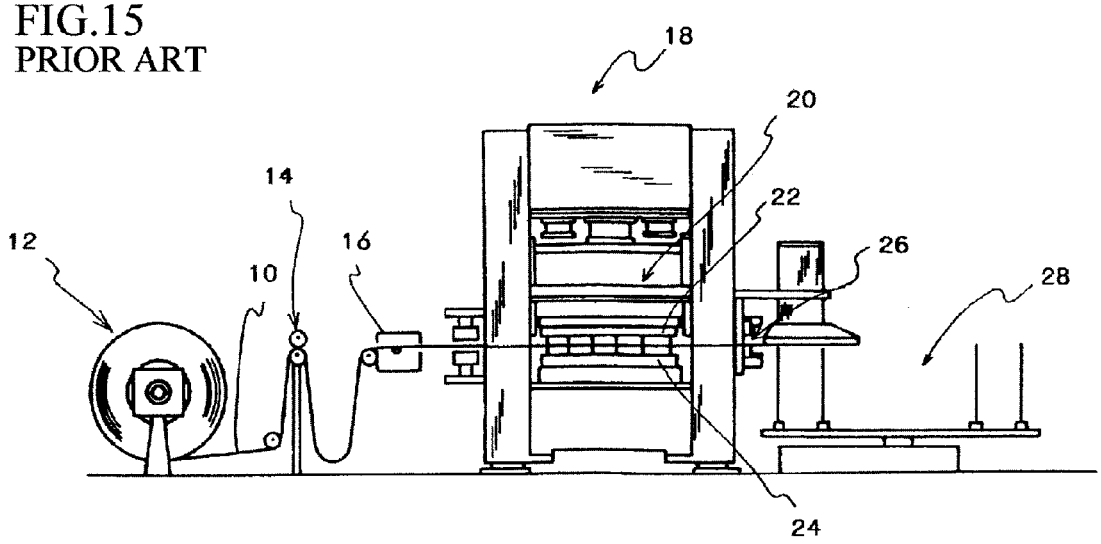
FIG.15 PRIOR ART
FIG. 15 is a diagram useful in explaining the overall construction of a manufacturing apparatus for heat exchanger fins.
Figure 16:
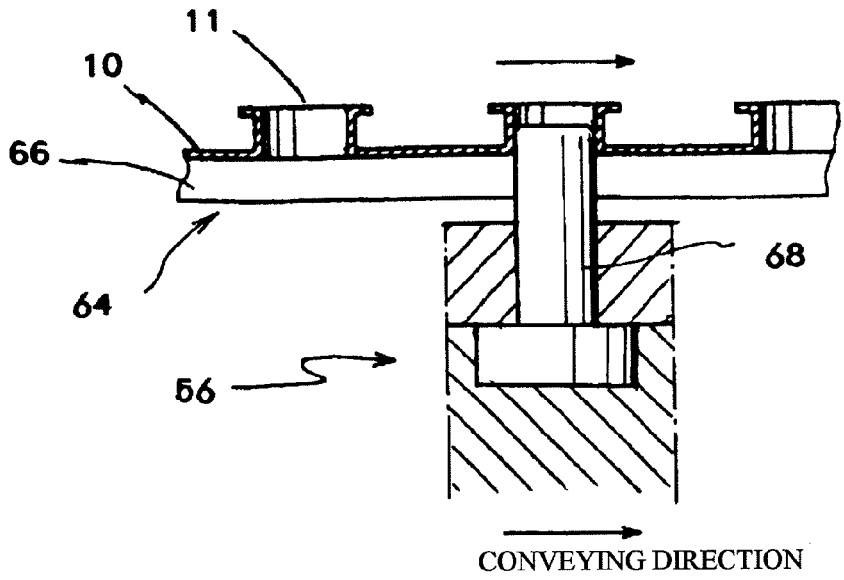
FIG.16 PRIOR ART
FIG. 16 is a diagram useful in depicting a state where a metal strip is being conveyed by feed pins.
Figure 17:
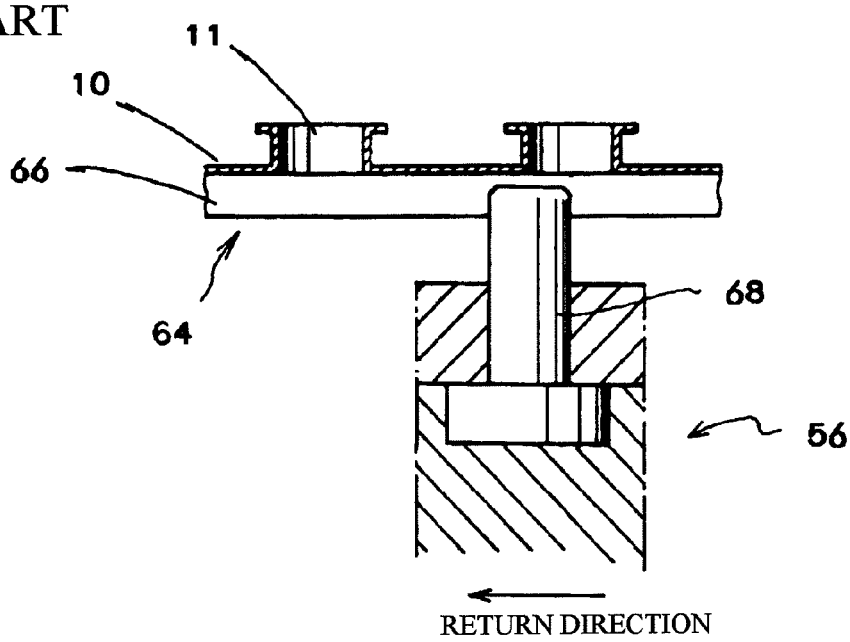
FIG.17 PRIOR ART
FIG. 17 is a diagram useful in depicting a state where the feed pins return to an initial position after conveying the metal strip.
Figure 18:
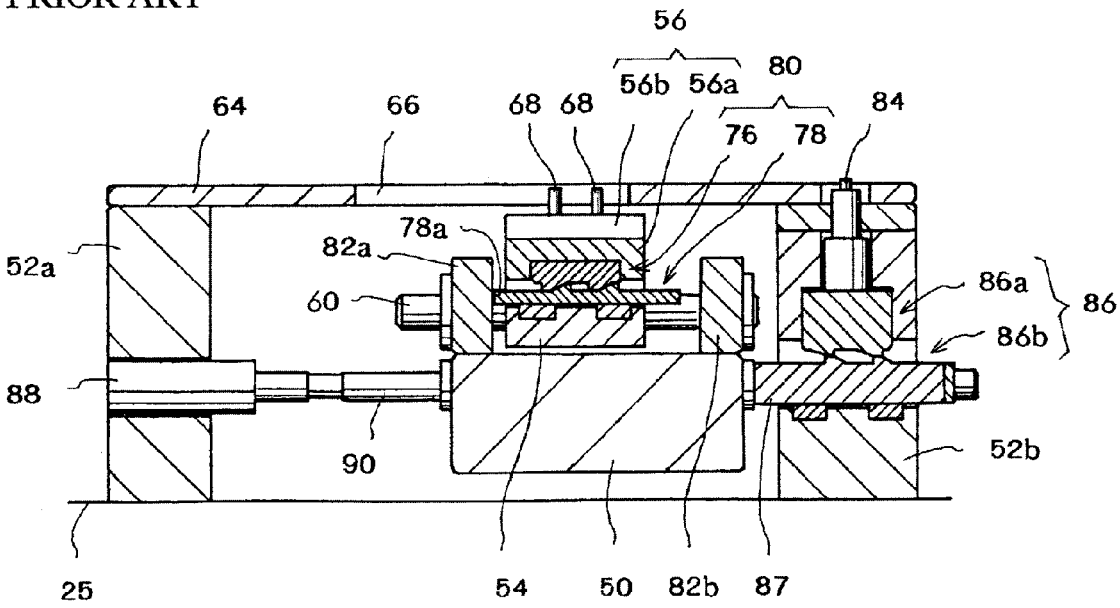
FIG.18 PRIOR ART
FIG. 18 is a diagram useful in depicting, for a construction for raising and lowering the pin block, a state where a moving block has reached a final position and the feed pins have been lowered.
Figure 19:
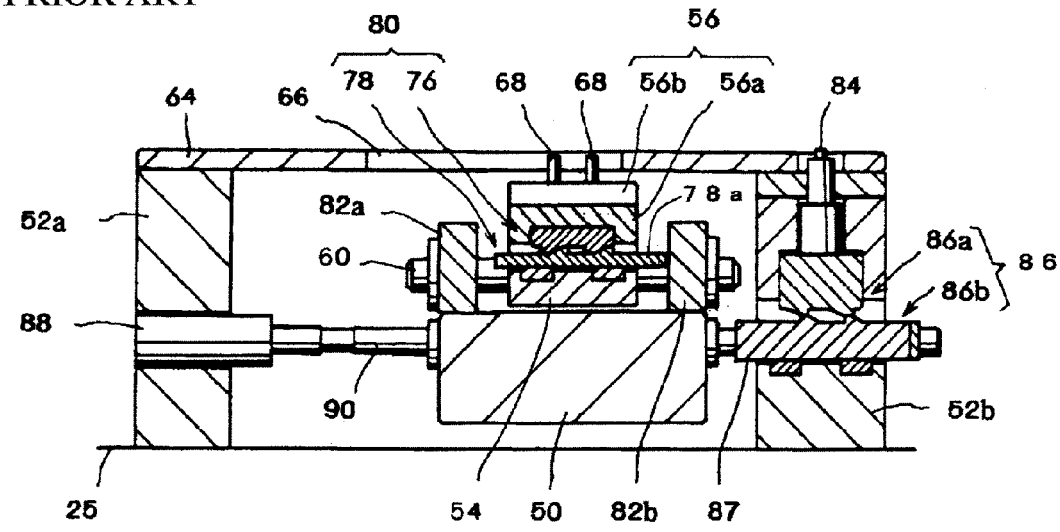
FIG.19 PRIOR ART
FIG. 19 is a diagram useful in depicting a state where the moving block is about to return toward an initial position from the state in FIG. 18.
Figure 20:
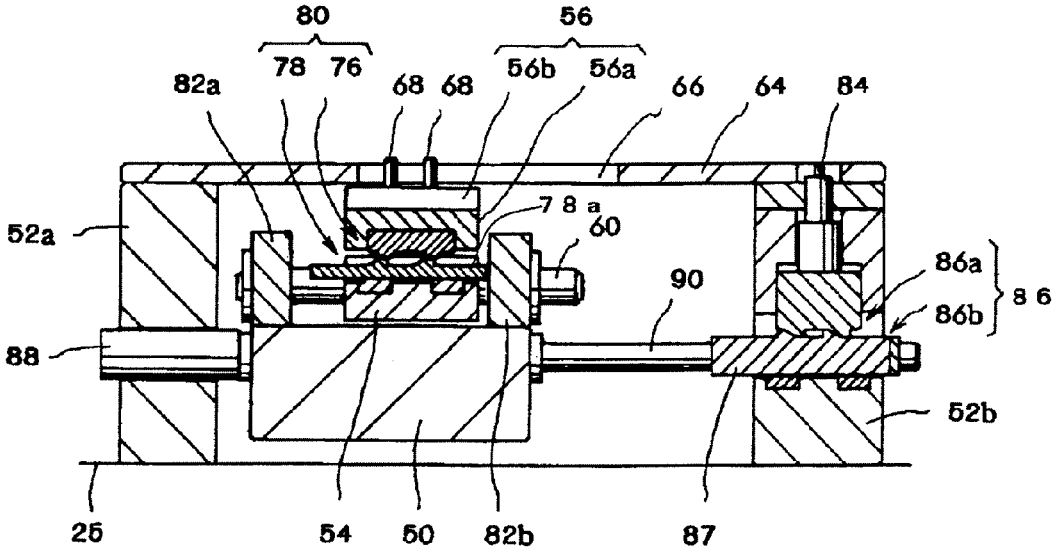
FIG.20 PRIOR ART
FIG. 20 is a diagram useful in depicting a state where the moving block has returned to the initial position from the state in FIG. 19.
Figure 21:
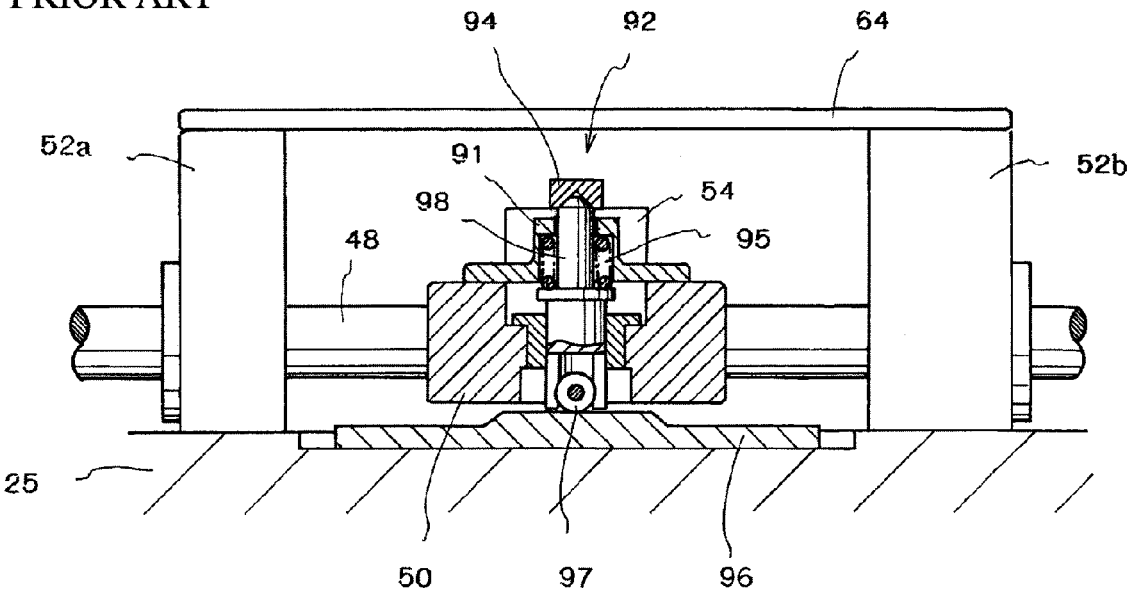
FIG.21 PRIOR ART
FIG. 21 is a diagram useful in depicting the engagement construction of an existing moving block and reciprocating block.
Figure 22:
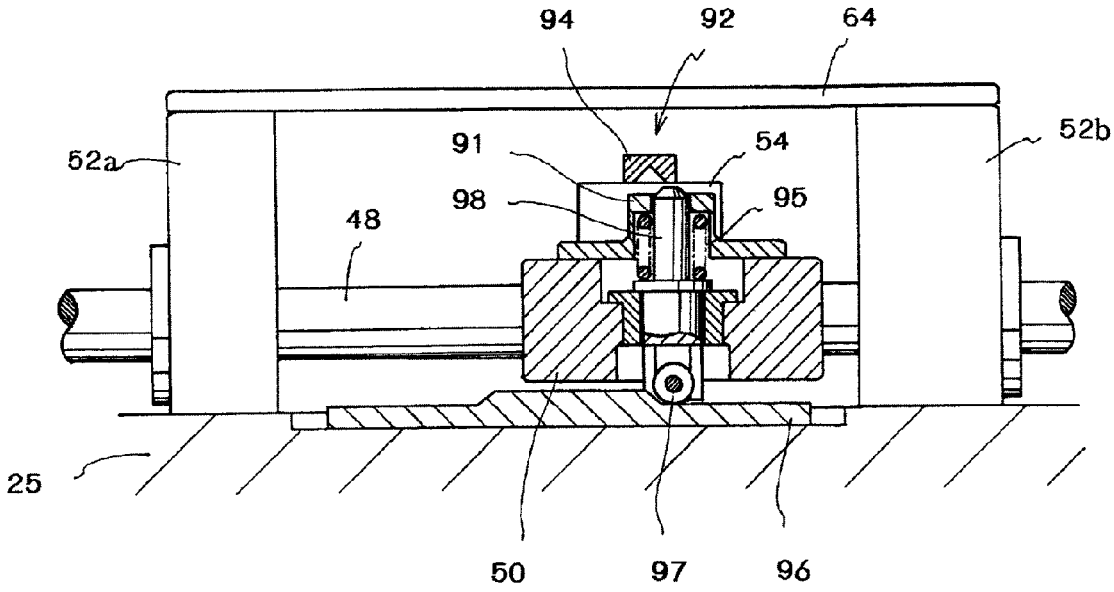
FIG.22 PRIOR ART
FIG. 22 is a diagram useful in depicting a state where engagement of the existing reciprocating block and moving block has been released.

With the construction depicted in FIG. 14, an inner wall surface 116*a* on the conveying direction side of the channel 116 and the outer circumferential wall (peripheral end surface) 110*a* of the cam 110 form a frame portion 118 that is formed into a predetermined shape. The cam follower 111 is inserted into the channel 116 and contacts the inner wall surface 116*a* of the channel 116. A second cam follower 120 which is disposed so as to contact the outer circumferential wall 110*a* of the cam 110 and sandwiches the frame portion 118 in combination with the cam follower 111 is also provided. The cam follower 111 and the second cam follower 120 are both attached to a bracket provided on the moving block 102. The cam follower 111 and the second cam follower 120 sandwich the frame portion 118 from the inside and the outside and cause the moving block 102 to move along the shape of the frame portion 118.

The overall shape of the frame portion 118 is formed in a smooth curve. In the same way as in the first embodiment, a first stationary zone A1 where the moving block 102 is stopped is formed near one end of the frame portion 118. Following the first stationary zone A1, a moving zone A2 is formed so that the moving block 102 starts to move gradually with no sudden acceleration immediately after the start of movement from the initial position and so that the moving block 102 gradually accelerates thereafter, and then a second stationary zone A3 where the moving block 102 is stopped is formed.

In this way, by forming the shape of the frame portion 118 of the cam 110 that moves the moving block 102 so that no sudden acceleration or sudden deceleration is produced in the movement of the moving block 102, it is possible to reduce the load upon the metal strip 10 into which the feed pins 68 provided on the moving block 102 have been inserted, and to also increase the feeding precision.

By restraining the cam follower 111 and the second cam follower 120 on the cam 110 to move the moving block 102, it is possible to cause both the movement of the moving block 102 from the initial position to the end position (outward movement) and the movement from the end position to the initial position (return movement) to follow the rotation of the cam. That is, if a construction were used where the cam followers 111, 120 are not restrained on the cam 110 and the cam follower 111 is pressed by a peripheral end surface of the cam 110, to return the moving block 102 that has moved to the end position to the initial position, it would be necessary to provide a spring or the like on the moving block 102 or at the end position of the moving block 102 and to return the moving block 102 to the initial position using the energizing force of the spring. However, by restraining the cam follower 111 and the second cam follower 120 that are fixed to the moving block 102 on the cam 110 as in the embodiment described above, it is possible to move the moving block 102 using only rotation of the cam 110 even when the moving block 102 returns from the end position to the initial position, which means that there is no need to provide a spring or the like and contributes to a reduction in the number of components.

Other Embodiments

Although an example where the moving block 102 moves so that a position thereof with respect to the rotation of the cam 110 traces a sine curve has been described in the above embodiment, provided that sudden acceleration and sudden deceleration do not occur, the moving block 102 does not need to move so as to trace a sine curve.

Although the present invention has been described above by way of the preferred embodiments, the present invention is not limited to such embodiments and it should be obvious that various modifications may be implemented without departing from the scope of the invention.

What is claimed is:

1. A feeder apparatus for feeding a metal strip, in which a plurality of through-holes have been formed, in a predetermined direction, the feeder apparatus comprising:

a reference plate having an upper surface on which the metal strip is placed and having slits that extend in a conveying direction of the metal strip and pass through the reference plate so as to connect the upper surface and a lower surface of the reference plate;

a reciprocating block that is provided below the reference plate and is moved reciprocally in a conveying direction of the metal strip and an opposite direction to the conveying direction in parallel to the reference plate by a driving means;

a moving block that is disposed above the reciprocating block and is connected to a connecting member so as to be movable in a moving direction of the reciprocating block between a pair of fixed members that are fixed facing one another near both ends perpendicular to a direction of reciprocal movement of the reciprocating block;

a pin block provided so as to be capable of moving together with the moving block and of moving up and down toward the reference plate, and on which feed pins, whose front end portions are inserted into the through-holes of the metal strip placed on the reference plate, are provided;

an upper-lower cam portion composed of an upper cam portion fixed to the pin block and a lower cam portion provided on the moving block opposite the upper cam portion, wherein the upper-lower cam portion is operable when the reciprocating block moves in the conveying direction of the metal strip, to raise the pin block toward the reference plate so that the front end portions of the feed pins advance into the slits of the reference plate and are inserted into the through-holes of the metal strip placed on the reference plate, and is operable when the reciprocating block moves in the opposite direction to the conveying direction of the metal strip, to lower the pin block toward the reciprocating block so that the front end portions of the feed pins are withdrawn from the through-holes of the metal strip placed on the upper surface of the reference plate;

a movement converting means that converts reciprocal movement of the reciprocating block to a rotational operation that has a width direction of the metal strip that is perpendicular to the conveying direction as an axis; and a cam that is rotated by the movement converting means with the width direction of the metal strip that is perpendicular to the conveying direction as an axis and has a channel formed in a predetermined shape along a surface of the cam, wherein a cam follower which is inserted into the channel of the cam and is capable of moving along the channel in the conveying direction according to the rotation of the cam is provided on the moving block, and the channel of the cam is formed in a shape so that the movement of the cam follower in the conveying direction causes the speed of the moving block immediately after the start of movement toward the conveying direction from the initial position to become gradually faster and the speed of the moving block before reaching the end position at the front end in the conveying direction to become gradually slower.

2. The feeder apparatus for the metal strip according to claim 1, wherein an inner wall surface on the conveying direction side of the channel and an outer circumferential wall of the cam form a frame portion formed in a predetermined shape, and a second cam follower that is disposed so as to contact the outer circumferential wall of the cam, sandwiches the frame portion in combination with the cam follower, and is capable of moving in the conveying direction along the shape of the frame portion is provided on the moving block.

* * * * *